United States Patent [19]

Nehls

[11] Patent Number: 4,703,535

[45] Date of Patent: Nov. 3, 1987

[54] SWIMMING POOL CLEANING BRUSH

[76] Inventor: Harold W. Nehls, 6332 - 205th St., Bristol, Wis. 53104

[21] Appl. No.: 861,850

[22] Filed: May 12, 1986

[51] Int. Cl.[4] ..... E04H 3/20

[52] U.S. Cl. ..... 15/1.7; 15/160; 15/398

[58] Field of Search ..... 15/1.7, 160, 398, 399, 15/400

[56] References Cited

U.S. PATENT DOCUMENTS 4,498,206 2/1985 Braukmann ..... 15/1.7
4,637,087 1/1987 Feinberg ..... 15/1.7

FOREIGN PATENT DOCUMENTS 334755 11/1903 France ..... 15/160

*Primary Examiner*—Peter Feldman
*Attorney, Agent, or Firm*—Peter N. Jansson, Ltd.

[57] ABSTRACT

A brush for underwater cleaning of swimming pool edges and corners having a convex cylindrical bristle-mounting surface, bristles extending therefrom with distal ends which form a second convex cylindrical surface, and means for attachment of an elongated handle member. Preferred embodiments relate to certain curvature characteristics of the bristle and bristle-mounting surfaces, the 90- or near 90-degree arc of such surfaces, characteristics relating to suction through the brush member for removal of loosened dirt, and the rigidity of brush member, all of which serve to provide good cleaning of underwater edges and corners of varying profiles.

15 Claims, 4 Drawing Figures

SWIMMING POOL CLEANING BRUSH

FIELD OF THE INVENTION

This invention is related generally to brushes and, more particularly, to brushes for underwater cleaning of swimming pools and the like.

BACKGROUND OF THE INVENTION

One of the best warm weather pleasures is swimming or relaxing at a swimming pool—whether it is a large public swimming pool or a swimming pool at a private home. The number of swimming pools is increasing rapidly, particularly the number of private pools of all kinds. In-ground and above-ground pools at private homes dot the landscape in both warm and temperate climates.

While the pleasures of a swimming pool are considerable, every swimming pool owner knows all too well about the continuing and arduous task of swimming pool upkeep. Without frequent, if not daily, action to clean a pool, its sides and bottom will soon be covered by algae, scum, and dirt of various other kinds.

The task of cleaning underwater pool surfaces, such as the pool walls, bottoms, and the edges and corners joining them, is very difficult. Implements of various kinds are used, including brushes and scrubbers, and so-called pool vacuums are often used to remove and capture (in a filter) dislodged dirt.

The work of dislodging dirt is very difficult because of the resistance of the water to scrubbing or other dislodging movements. Such action is particularly difficult in the rounded edges and corners of the pool. Edges and corners are, of course, usually at the bottom of the pool where the water is deepest, and are therefore usually the most difficult parts to clean because of the resistance of the water to scrubbing motions.

Cleaning of edges and corners is made even harder by the optical refraction which interferes with the normal coordination between sight and cleaning movements. This is made particularly difficult when the scrubbing tool itself, even when properly applied to an underwater edge or corner, does not provide the "feel" of proper engagement with that part of the pool surface.

Many swimming pool cleaning implements of the prior art do not function very well in cleaning underwater edges and corners of swimming pools. As a result, such areas, which are often the most prone to accumulate algae, scum, and other dirt, are often inadequately cleaned. Many swimming pool owners and others engaged in pool maintenance are well aware of the difficulties of cleaning pool edges and corners, and not a few have been known to wish they had never purchased their pools because of such difficulties.

The prior art includes a great variety of brush devices, including many brushes for specialized tasks. Included in the prior art are the following patents:

U.S. Pat. No. 59,932
U.S. Pat. No. 176,018
U.S. Pat. No. 313,776
U.S. Pat. No. 378,784
U.S. Pat. No. 389,531
U.S. Pat. No. 554,339
U.S. Pat. No. 630,844
U.S. Pat. No. 637,328
U.S. Pat. No. 857,038
U.S. Pat. No. 3,425,084

U.S. Pat. No. 3,704,915
U.S. Pat. No. 3,761,990

Despite the variety of brushes and cleaning devices in the prior art, there remains a substantial need for an improved swimming pool cleaning brush for cleaning underwater edges and corners which will overcome some of the aforementioned problems and deficiencies.

SUMMARY OF THE INVENTION

This invention is a brush for underwater cleaning of swimming pool edges and corners. The brush includes a bristle-mounting surface which is a convex cylindrical surface. Bristles extend from the bristle-mounting surface and have distal ends which together form another convex cylindrical surface.

The bristle-mounting surface is on one side of a base member. The base member also includes means, preferably on the side opposite the bristle-mounting surface, for attaching an elongated member which forms a handle by which the brush is held and manipulated during use.

As used herein, the term "cylindrical surface" is a mathematical term which means a surface consisting of all straight lines parallel to a given line and intersecting a given curve. See *Mathematics Dictionary,* VanNostrand Reinhold Company, 1976, pages 96–97. Such surfaces have a simple two-dimensional curvature, rather than a complex three-dimensional curvature. Both the bristle-mounting surface of the base member and the surface formed by the distal ends of the bristles are such cylindrical surfaces, and both are convex rather than concave. Their curvature approximates the profile of a typical swimming pool edge. "Cylindrical" does not necessarily require circular cylinders.

The base member, which includes the bristle-mounting surface from which the bristles extend, has edge portions spaced from such the attachment means, to which the elongated handle member is attached. In preferred embodiments, the base member is substantially rigid, rather than flexible, and such rigidity allows the base member to provide substantially inflexible support for the bristles even at such edge portions. Thus, such rigidity is helpful in transferring applied scrubbing force through the bristles to the swimming pool surface.

The convex cylindrical surfaces of the bristle-mounting surface and the surface defined by bristle ends, which are adjacent to one another, have central portions and extend therefrom along arcs in either direction to two opposite ends. In preferred embodiments, the bristles at the central portion are longer than the bristles at the ends. In the most preferred embodiments, the bristles are progressively shorter at positions progressively closer to the ends. This configuration helps greatly to improve brushing action in corners and edges. It is also helpful in allowing the brush of this invention to accommodate edges and corners of varying profiles without sacrificing cleaning ability.

In preferred embodiments, one and preferably both of the convex cylindrical surfaces are portions of substantially circular cylindrical surfaces. The convex cylindrical surface formed by the distal ends of the bristles preferably has a radius which is less than the radius of the bristle-mounting surface. This preferred form is particularly helpful in improving brushing action in corners and edges, even in corners of differing curved profiles.

In highly preferred embodiments, the convex cylindrical surfaces each extend along arcs in excess of 75 degrees, and are most preferably on the order of about 90 degrees. Thus, all or substantially all of an underwater swimming pool edge or corner, despite its exact profile, can be engaged by the brush of this invention. And, the simple rather than complex curvature of the brush allows bristles along the full width of the brush to engage the swimming pool surface during brushing actions.

It is highly preferred that the base member include an orifice to allow water to be drawn through it by suction for removal of dirt and algae loosened in the brushing motions. A standard pool vacuum system can be used to provide such vacuuming action.

The orifice through the base member preferably communicates with a fluid passageway extending through the attachment means, which is on the base member, and through the elongated handle member. The orifice through the base member is preferably surrounded by bristles on the bristle-engaging surface. Thus, the suction action is effective at the point that dirt and algae are loosened by the bristles.

Highly preferred embodiments of this invention include a lip surrounding the bristle-mounting surface and extending therefrom in a direction generally parallel to the bristles. Such lip forms, with the bristle-mounting surface, a sort of plenum which serves to increase the effectiveness of the suction action near the bristles.

The brush configuration of this invention has greatly improved effectiveness in cleaning underwater edges and corners of swimming pools. It gives the person using it, who is usually standing in the water, the feel of scrubbing in the right location. And it effectively removes algae, scum and other dirt with less effort than is exerted in using certain devices of the prior art.

OBJECTS OF THE INVENTION

It is an object of this invention to provide a brush for underwater cleaning of swimming pool edges and corners overcoming some of the problems and shortcomings of devices of the prior art.

Another object of this invention is to provide a brush for underwater cleaning of swimming pool surfaces which is particularly effective in cleaning edges and corners.

Another object of this invention is to provide a brush for underwater cleaning of swimming pool edges and corners which can readily be kept in proper engagement with a corner or edge during cleaning.

Another object of this invention is to provide a brush for underwater cleaning which can accommodate curved edges and corners of widely varying profiles.

Another object of this invention is to provide a brush for underwater cleaning having a bristle surface which can fully engage edges and corners for improved cleaning action.

These and other objects will be apparent from the following additional descriptions and from the drawings, wherein:

DETAILED DESCRIPTION OF PREFERRED EMBODIMENTS

Figure 2:
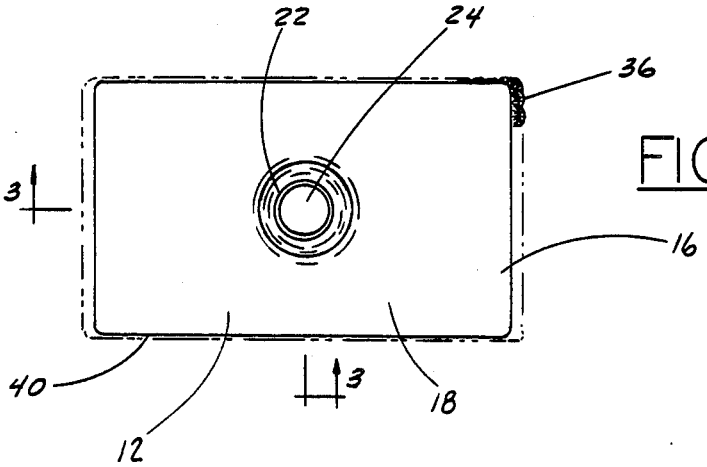
FIG. 2 is an enlarged fragmentary top plan view.
Figure 3:
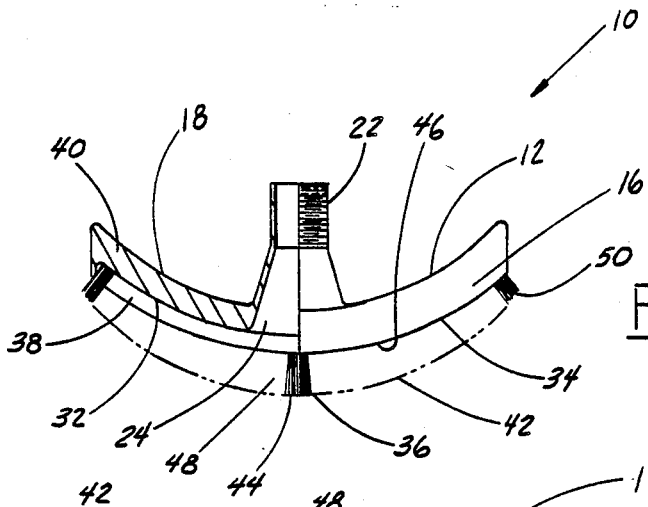
FIG. 3 is a partially sectional side elevation, the sectional portion being taken along section 3—3 as shown in FIG. 2.
Figure 4:
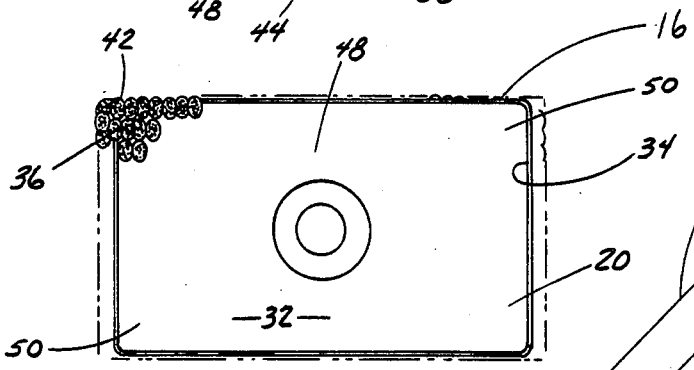
FIG. 4 is an bottom plan view.
Figure 1:
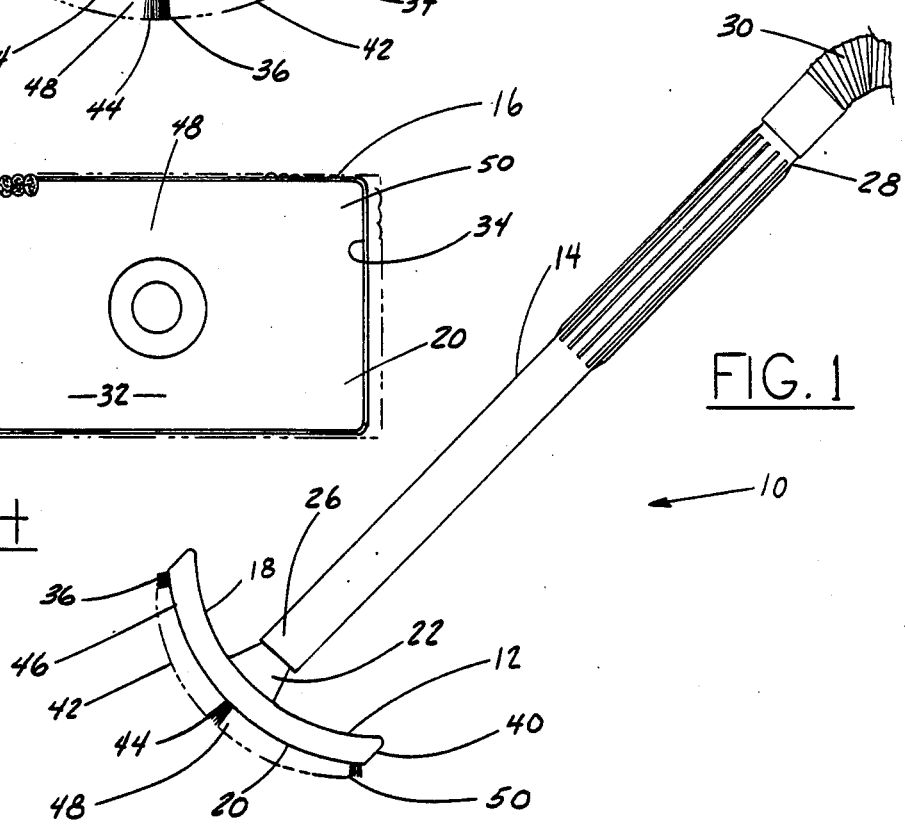
FIG. 1 is a perspective view of the improved brush apparatus of this invention.

The figures illustrate a brush apparatus 10 including a brush member 12 and an elongated handle member 14. Brush member 12 is moved in a scrubbing action against underwater edges and corners of a swimming pool through elongated handle member 14, the upper portion of which is held by a person engaged in pool cleaning operations.

Brush member 12 includes a base member 16 having upper and lower sides 18 and 20, respectively. Integrally formed with base member 16 on its upper side 18 is a short attachment tube 22 which surrounds an orifice 24 extending through base member 16. Handle member 14, which is itself an open-ended hollow tube, has a lower end 26 which is sleeved over attachment tube 22, the two parts being threaded for reliable fluid-tight inter-engagement.

Elongated handle member 14 also includes an upper end 28 which may be attached to a flexible suction hose 30. During use of this invention, suction hose 30 is used to connect elongated handle member 14 to a swimming pool suction system. Thus, orifice 24 communicates with the pool's suction system by means of a continuous fluid passageway extending through attachment tube 22, elongated handle member 14, and suction hose 30.

Brush member 12 includes a bristle-mounting surface 32 which is entirely surrounded by a lip 34. Bristles 36 extend from bristle-mounting surface 32 and are secured to base 16 at bristle-mounting surface 32. Each of the bristles 36 extends in a direction perpendicular to bristle-mounting surface 32 at its point of attachment to such surface.

Bristles 36 surround orifice 24, which is in good position with respect to bristles 36 to be effective in removing loosened particles through suction action. Lip 34 and bristle-mounting surface 32, when brush member 12 is against a curved edge or corner surface of the swimming pool, form a plenum 38 which increases the effectiveness of the suction action.

Turning now to certain important characteristics of this invention, bristle-mounting surface 32 is a convex cylindrical surface, that is, a surface consisting of all straight lines which are parallel to a given line and intersect a convex curve. More specifically, bristle-mounting surface 32 is a portion of a circular cylindrical surface. The edge profile 46 of lip 34 is substantially parallel to bristle-mounting surface 32.

The surface 42 which is formed by the distal ends of all of the bristles, sometimes referred to as the bristle surface, extends beyond edge profile 46 of lip 34. Bristle surface 42 is, like bristle-mounting surface 32, a convex cylindrical surface. And, like bristle-mounting surface 32, bristle surface 42 is a portion of a circular cylindrical surface.

However, the radius of bristle surface 42 is shorter than the radius of bristle-mounting surface 32, such that the bristles in the central portion 48 of such cylindrical surfaces are longer than the bristles at the ends 50 of such cylindrical surfaces. By virtue of such configuration, bristles 36 are progressively shorter at positions progressively closer to ends 50. This configuration improves brushing action in underwater corners and edges of swimming pools. Furthermore, such configuration makes brush member 12 more adaptable to clean swimming pool edges and corners of varying curved profiles.

The convex cylindrical surfaces of bristle-mounting surface 32 and bristle surface 42 each extend along arcs slightly less than 90 degrees. This is helpful in allowing brush member 12 to properly engage underwater corners and edges in swimming pools. It is highly preferred that the convex cylindrical surfaces each extend along arcs which are in excess of 75 degrees, and most preferred that such surfaces each extend along arcs of about 90 degrees.

Base member 16 is made of a substantially rigid and inflexible material, such that firm scrubbing pressure can be applied to the pool surface by the entire brush. More specifically, when scrubbing pressure is applied through elongated handle member 14 and the edge portions 40 of base member 16, that is, the portions spaced from attachment tube 22, will not flex to any significant extent.

Base member 16 may be made of light metals, such as aluminum, high-density polypropylene or a wide variety of other plastics, or other tough materials. The material chosen should be strong to withstand tension and abuse, and should also be able to withstand pool chemicals and weather. Elongated handle member 14 should be made of similar materials.

In a preferred form, brush member 12 will be approximatelly 10 inches in length and 6 inches in width, and have a radius of curvature of approximately 7½ inches. Lip 34, around bristle-mounting surface 32, extends approximately ½ inch beyond bristle-mounting surface 32. Bristles 36 are approximately 1 inch in length at ends 50 and are progressively longer at positions progressively closer to central portion 48, at which point the bristle length is approximately 1½ inches. These dimensions are particularly useful in accommodating a wide variety of swimming pool edge and corner curve profiles, and in allowing effective cleaning action.

Bristles 36 may be made of relatively stiff bristle materials of various kinds—either natural or synthetic. One suitable bristle material is nylon. Bristles 36 should be relatively stiff and resilient, so that they reassume their normal configuration after bending during brushing actions. Bristles 36 may be imbedded into or otherwise attached to bristle-mounting surface 32 using known techniques.

A wide variety of variations are possible in the brush apparatus of this invention. While the principles of this invention have been described in connection with specific embodiments, it should be understood clearly that these descriptions are made only by way of example and are not intended to limit the scope of the invention.

What is claimed is:

1. In a brush for underwater cleaning of swimming pool edges and corners of the type including a base member with a bristle-mounting surface, bristles extending therefrom, attachment means on the base member, an elongated member secured to the base member by the attachment means and having a portion spaced from the base member for holding the brush during cleaning operations, the improvement comprising:

the bristle-mounting surface being a first convex cylindrical surface;

the bristles having distal ends together forming a second convex cylindrical surface; and the first and second cylindrical surfaces extending along arcs in opposite directions from a central portion to two opposite ends, the bristles at the central portion being longer than bristles at the ends, said bristles being progressively shorter at positions closer to the ends, thereby to provide improved brushing action in the corners and edges.

2. The brush of claim 1 wherein the base member has edge portions spaced from the attachment means, and wherein the base member is substantially rigid, thereby providing substantially inflexible support for the bristles at the edge portions during brushing.

3. The brush of claim 1 wherein the first convex cylindrical surface comprises a portion of a substantially circular cylindrical surface.

4. The brush of claim 1 wherein the second convex cylindrical surface comprises a portion of a substantially circular cylindrical surface.

5. The brush of claim 1 wherein the first and second convex cylindrical surfaces each comprise a portion of a substantially circular cylindrical surface.

6. The brush of claim 5 wherein the second surface has a radius less than the radius of the first surface, thereby to improve brushing action in corners and edges.

7. The brush of claim 5 wherein the first and second convex cylindrical surfaces each extend along arcs in excess of 75 degrees.

8. The brush of claim 7 wherein the first and second convex cylindrical surfaces each extend along arcs of about 90 degrees.

9. The brush of claim 1 wherein the base member includes an orifice to allow water to be drawn therethrough by suction to remove dirt and algae loosened by the bristles.

10. The brush of claim 12 having a fluid passageway extending through the attachment means and the elongated member.

11. The brush of claim 9 wherein the bristle-mounting surface extends to the orifice and is substantially entirely covered with bristles immediately adjacent to the orifice and extending outwardly therefrom.

12. The brush of claim 11 further including a lip surrounding and extending from the bristle-mounting surface in a direction substantially parallel to the bristles, thereby to form with the bristle-mounting surface a plenum to increase the effectiveness of the suction.

13. The brush of claim 12 wherein the base member has edge portions spaced from the attachment means, and wherein the base member is substantially rigid, thereby providing substantially inflexible support for the bristles at the edge portions during brushing.

14. The brush of claim 12 wherein the first and second convex cylindrical surfaces each comprise a portion of a substantially circular cylindrical surface, and the second surface has a radius less than the radius of the first surface, thereby to improve brushing action in corners and edges.

15. The brush of claim 14 wherein the first and second convex cylindrical surfaces each extend along arcs in excess of 75 degrees.

* * * * *